US005159583A

United States Patent [19]

Lee

[11] Patent Number: 5,159,583

[45] Date of Patent: Oct. 27, 1992

[54] DECORATIVE CLOCK DEVICE

[76] Inventor: Vincent K. W. Lee, No. 44, Lane 458, Sheh Chung Street, Taipei, Taiwan

[21] Appl. No.: 724,155

[22] Filed: Jul. 1, 1991

[51] Int. Cl.[5] ..... G04B 25/00

[52] U.S. Cl. ..... 368/223; 368/229; 368/134; 368/165; 368/179

[58] Field of Search ..... 368/134, 165, 179, 223, 368/229

[56] References Cited

U.S. PATENT DOCUMENTS 2,488,483 11/1949 Thatcher ..... 368/131

3,491,665 8/1969 Cielaszyk ..... 368/131

3,546,874 12/1970 Booty et al. ..... 368/131

*Primary Examiner*—Bernard Roskoski

*Attorney, Agent, or Firm*—Bacon & Thomas

[57] ABSTRACT

A combined clock and decorative liquid display wherein an oscillating pendulum of an electronic clock causes a float suspended in a body of liquid to move back and forth due to magnetic induction generated between a magnetic material carried by the pendulum and a magnetically attractive material carried by the float.

5 Claims, 8 Drawing Sheets

DECORATIVE CLOCK DEVICE

BACKGROUND OF THE INVENTION

This invention relates to liquid decorations, which are, at present, versatile both in types and styles, as shown in FIGS. 1 and 2.

These are actually the early models of common dual liquids drip decorations, which use the characteristics of the differences in specific gravity of two liquids and their mutual insolubility, and when the container is placed at its reverse position, it will then generate the dripping and promote the results of rotation and concentration. However, as far as the practical results are concerned, even though these types of liquid drip decorations may favorably attract consumers for a short time, its dripping action will not be automatic and requires manually reversing the container again for another dripping. Otherwise, it will stand still after one dripping.

There is also known a construction with a float standing vertically in between the interface of two liquids, as shown in the attached FIG. 3. When the users shake the liquid decorative wares, the two liquids will move like the waves in the ocean, even though the internal float is also moving consequently, but the float will maintain its vertical and unfalling position. This novelty structure and decorative results attract the favors and acceptances of consumers. However, even though the construction demonstrates excellent creative thoughts worthy for people to appreciate, its overall structure is a non-dynamic and static liquid decoration, without external force to control, its dynamical artistic conception and results will not be possible to demonstrate at all, thereby making its original expected effects incapable of being displayed anytime as one wishes, which is, therefore, the most regretable thing for such as innovative decoration.

It has been proposed to add a motor or anything that generate vibrations underneath this liquid decoration, by using electricity to enable the container generating vibrations to achieve the dynamic results. But, not only does this increase the cost of this product, but also, during the motor starting it will create a lot of noises, which are, therefore, not conform to the practicality principles, and are not able to occupy a good market share of the liquid decorations.

Therefore, under these circumstances, prior to finding a newer construction, the traders can only modify the containers' appearance of the liquid decorations to satisfy consumers favor of fashionable items. However, the limitations of lacking dynamic effects have so far no improving measures, thus affect the long-term development of this article.

SUMMARY OF THE INVENTION

The construction of a dynamic liquid decorative clock, indicates a combination of a time piece and a liquid decoration. The float inside the liquid decoration has a liquid decorative clock construction design with flexible dynamic results.

It is a clear and transparent housing, with an electronic time piece installed on the top side, attached with a magnetic induction type pendulum located at the exterior of the lower side of the hollow container.

Within the hollow container, the dual liquids and a float are housed. The sinkage part of the float is made of magnetic material, which will move left and right with the magnetic induction type pendulum because of the magnetic induction, thereby generating elegant and wonderful dynamic results.

DETAILED DESCRIPTION OF THE PREFERRED EMBODIMENT

Figure 1:
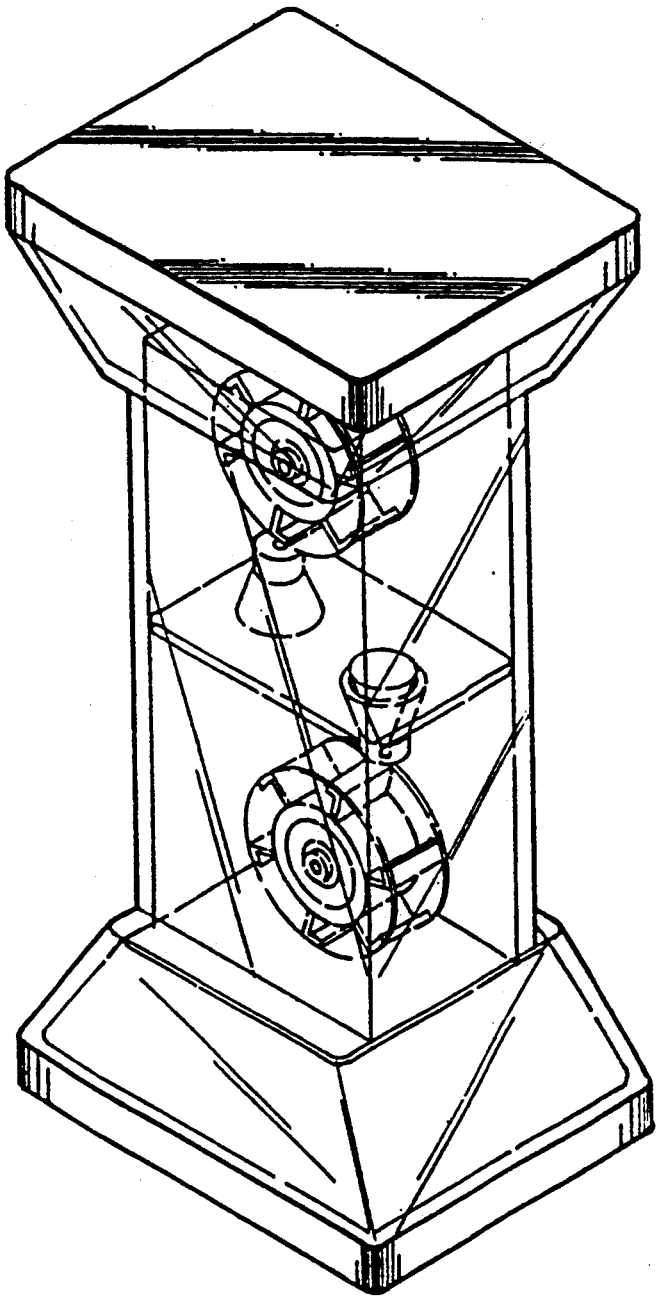
FIG. 1 is the pictorial drawing (1) of the conventional dual liquids drip type liquid decorations.
Figure 2:
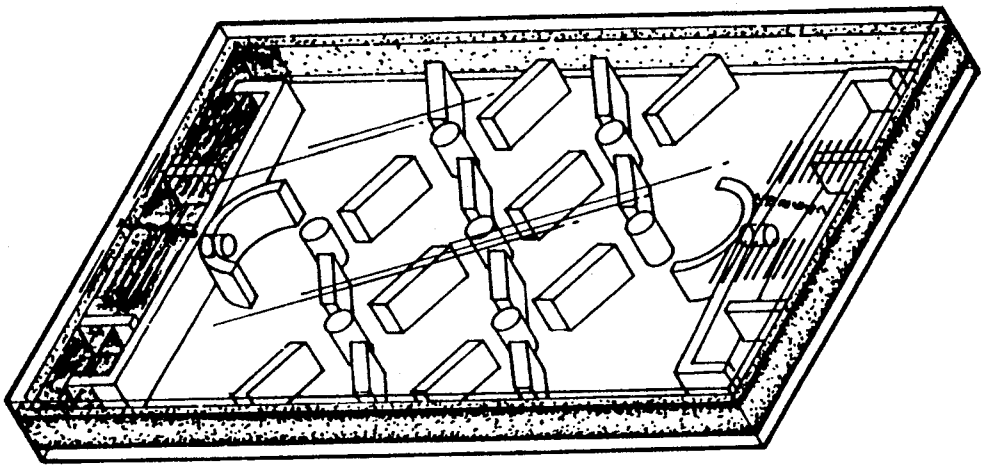
FIG 2 prior art
FIG. 2 is the pictorial drawing (2) of the conventional dual liquids drip type liquid decorations.
Figure 3:
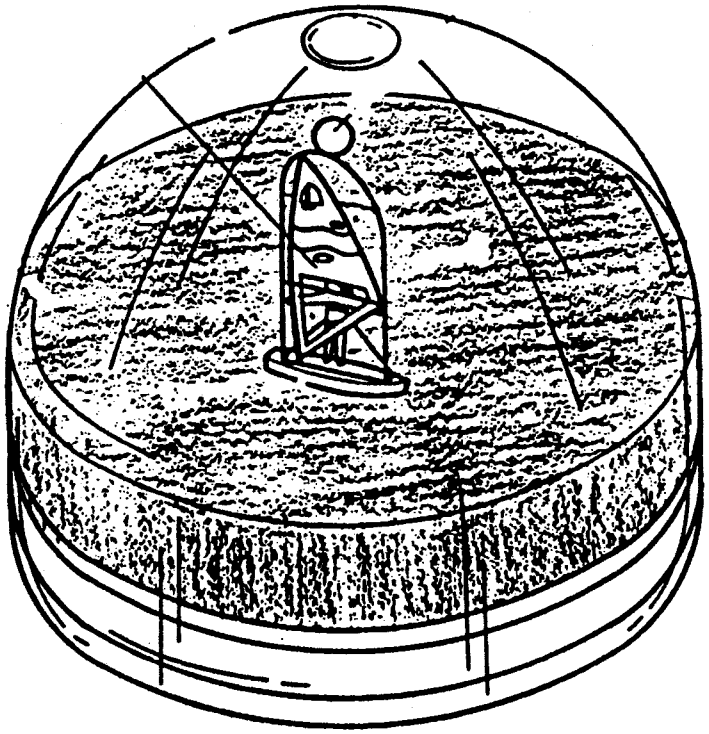
FIG 3 prior art
FIG. 3 is the pictorial drawing (1) of the conventional float type liquid decorations.
Figure 4:
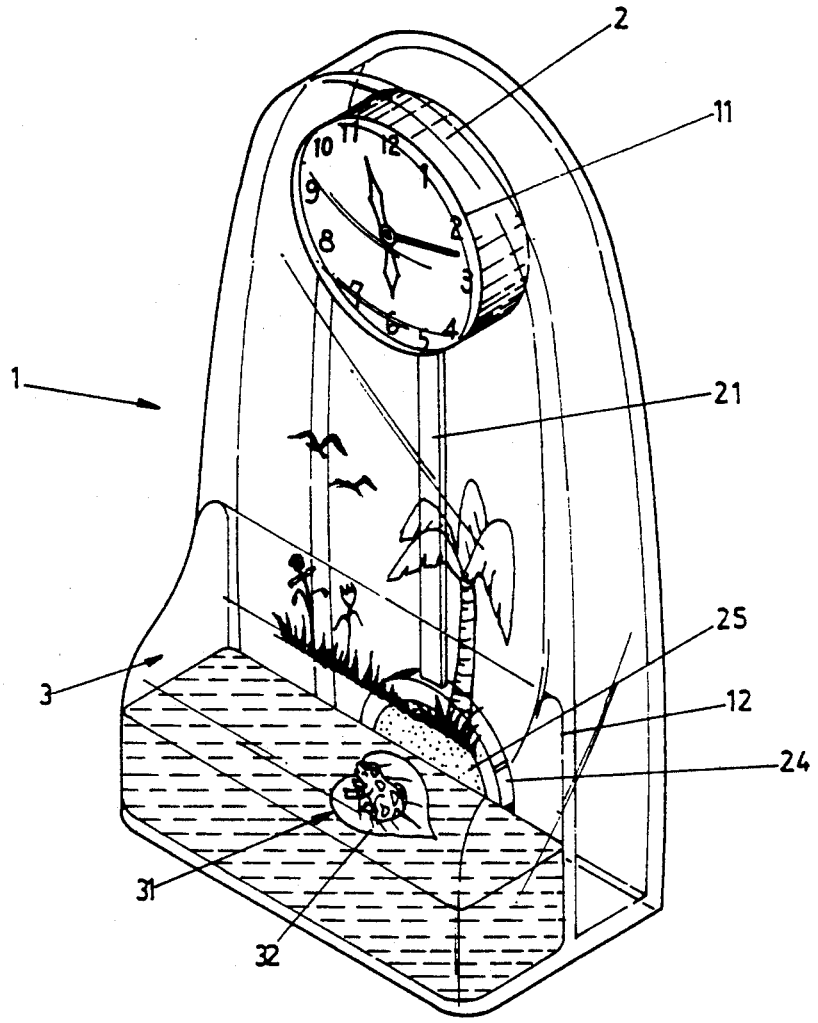
FIG. 4 is the pictorial schematic drawing of this invention.
Figure 5:
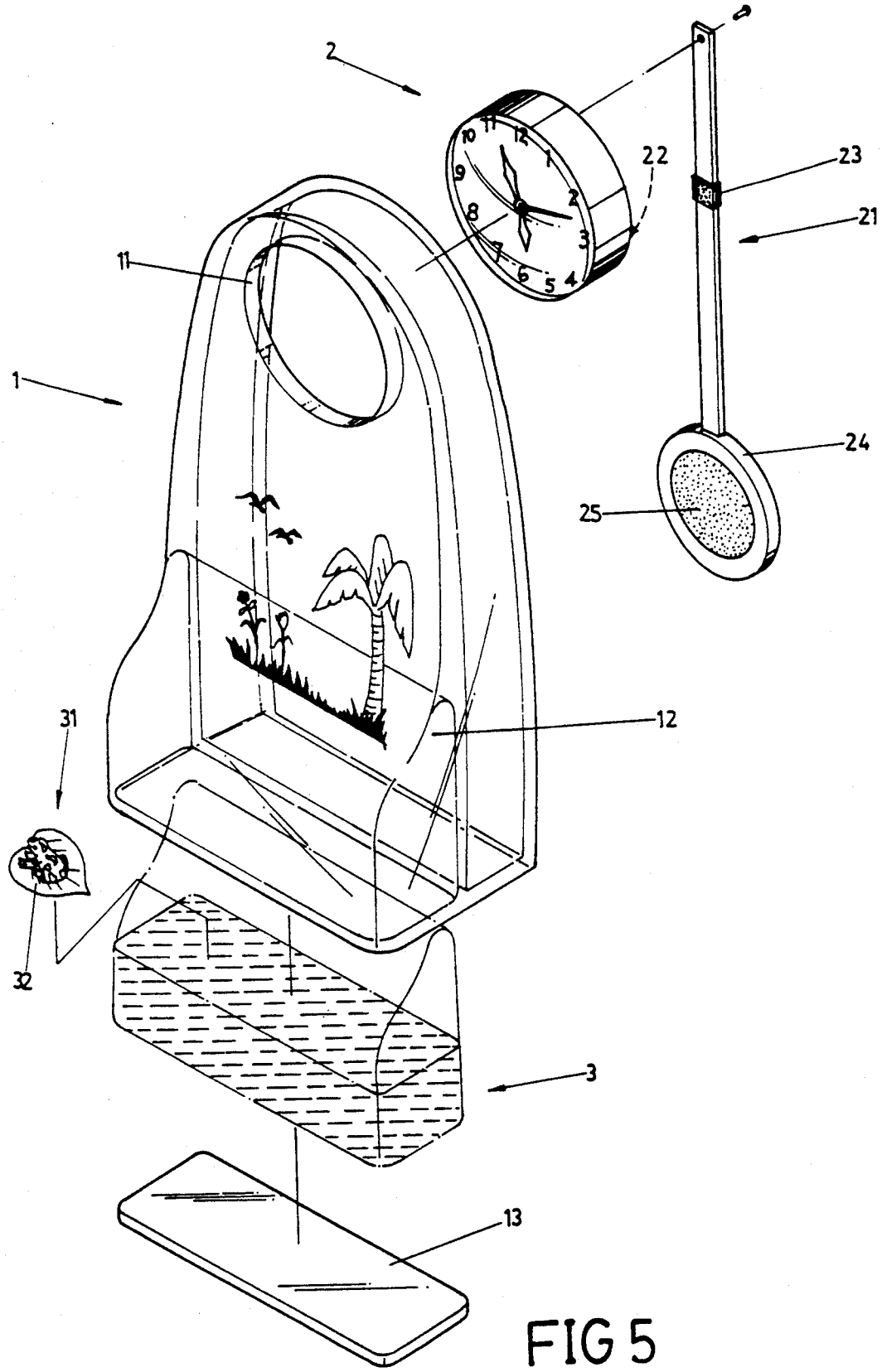
FIG. 5 is the disassembly schematic drawing of this invention.

Please refer to the attached FIGS. 4 and 5, this invention is a constructional design of a dynamic liquid decorative clock. It is a combination construction with dual functions of counting time and liquid decorations.

The construction is a clear and transparent housing (1) which is the main body of structural frame. On the upper side of the clear housing (1) a hollow inserting hole (11) is installed, within which is to be inserted an electronic time piece (2). The inner space of its lower side is a hollow container (12), which is used as a space for installing a liquid decorative device (3).

Even though the electronic time piece (2) is installed on the top side of the hosuing (1), its back sided pendulum (21) is installed vertically at the side of the hollow container (12) which is located at the lower side of the housing (1).

The upper side of the pendulum (21) nearby the time piece (2), and the corresponding place of coil (22) for the time piece (2), are installed with a small section or a sectional connected magnetic material (magnetic iron ) (23).

The magnetic induction generated by coil (22) because of electricity, will generate attractive force or thrust force to the magnetic material (23) on the pendulum (21), thereby enabling the pendulum to oscillate left and right without a stop. The theory of oscillation is a well known theory, and the pendulum is commonly seen on the market.

The top side of a plumb (24) of pendulum (21) rear the side of the hollow container (12) is also installed with a magnetic material (magnetic iron) (25). Therefore, following the oscillation of pendulum (21), the plumb (24) will generate a moving magnetic field arc line at the external side of hollow container (12).

The liquid decorative device (3) installed inside the hollow container (12) is constructed by two liquids of different specific gravity, different color, and which are not soluble with each other, and a float (31) is suspended at the interface of the two liquids.

Figure 6:
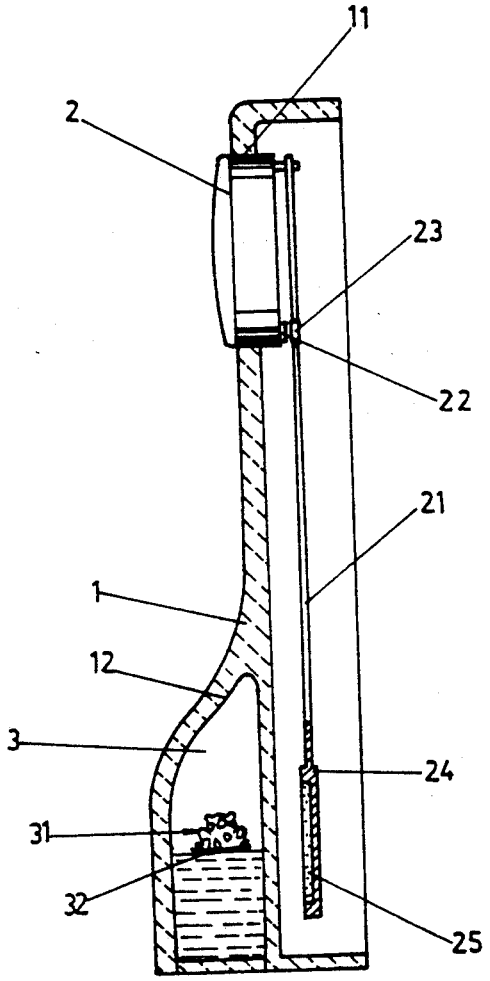
FIG. 6 is the sectional schematic drawing of this invention.
Figure 7:
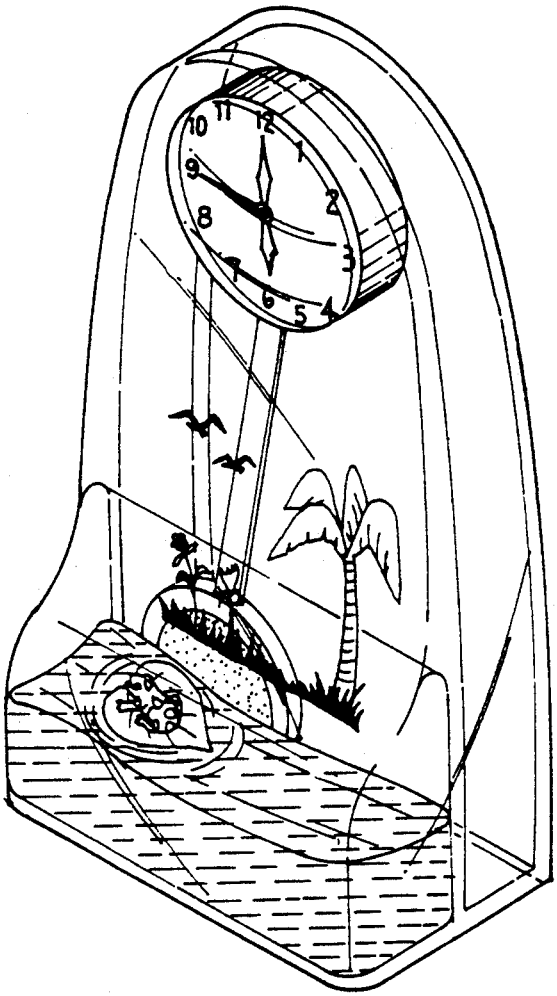
FIG. 7 is the implementing actions schematic drawing of this invention.

A sinkage (32) of the float (31) is made of a magnetically attractive material matter (such as ferrous material), which will generate a magnetic induction phenomenon with magnetic material. Therefore, even though the float (31) is installed in between the interface of two liquids in a superficial status, the float will also be affected by the magnetic force of the magnetic material (25) on the plumb (24) outside of the hollow container (12), and the float will follow the reciprocating oscillations of the plumb (24), and cause a dynamic phenomenon of moving left and right, as shown in FIGS. 6 and 7. The float will then generate an automated flexible dynamic scenerio without any external control force, and demonstrate a special result which has never been realized by this type of product, thereby effectively expanding its utilization and scope.

Figure 8:
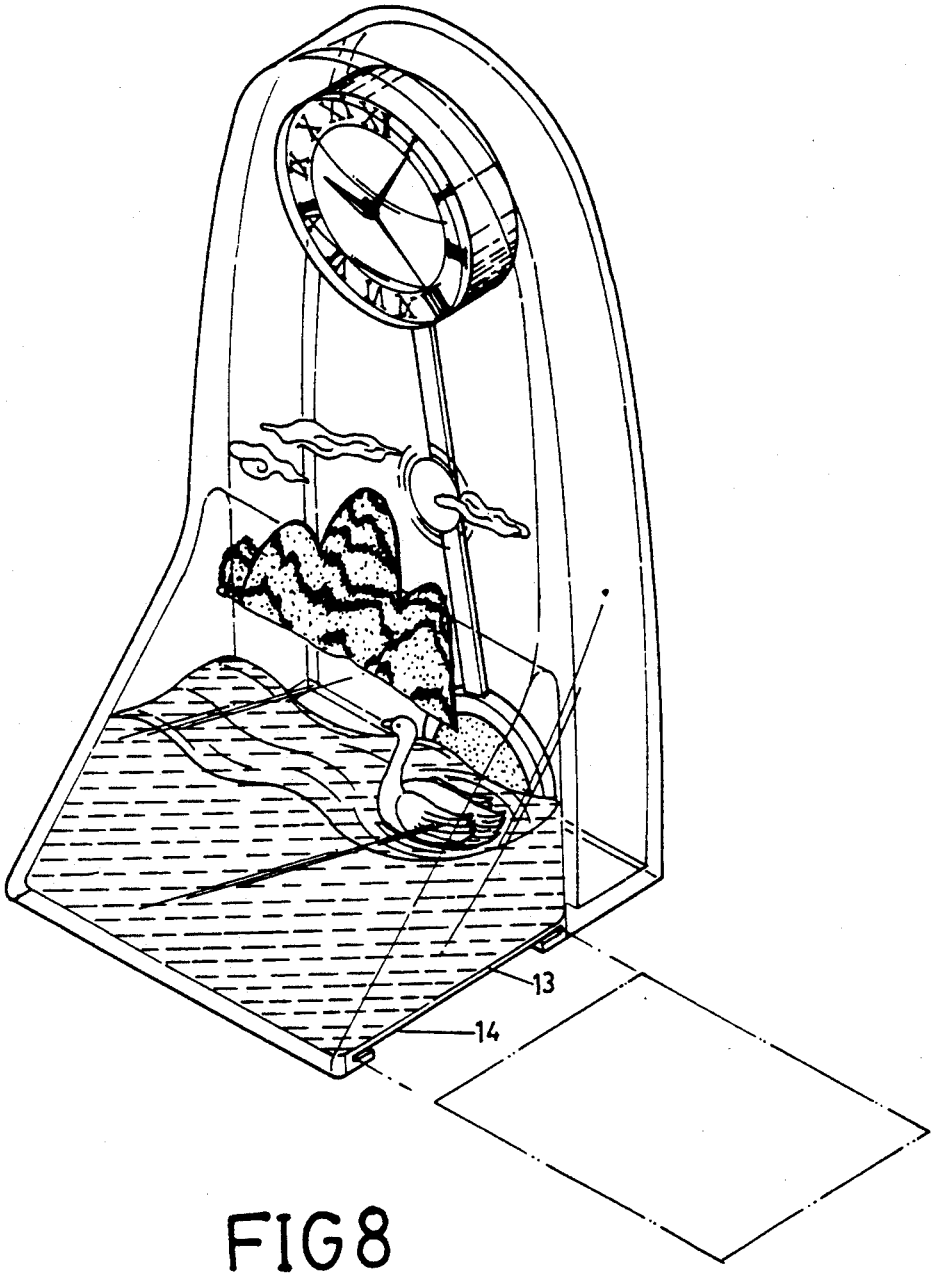
FIG. 8 is another implementing actions schematic drawing of this invention.

In addition, as shown in the implementing action drawing of FIG. 8, another feature of this invention is to install an insertion channel (14) with the shape of a reversed U slots which can house a picture or photograph, on the bottom cover plate (13) of the liquid decorative device (3).

The contents of the picture or photograph will be refracted through a diagonal panel of the shell (12) and shown in the front view.

Moreover, the shape of float (31) of this invention can be made in a heart form, or any other form representing some scenario, thereby making the scene of the photograph (such as a photograph of a couple of lovers facing each other with a tender love looking in their eyes) through the middle shifting and connecting of the float (31) expressing the affection, which the sky lovers might not dare to show.

Also, since the magnetic swinging displacement of a heart shaped float (31) is affected by the oscillation of the pendulum (21), the dynamic displayed is in an irregular motion which can not be controlled by any external force. The scenario shown is defined by alive and vivid irregular dynamic pictures, which will always offer an unique, novel and changing feeling from time to time, so that the consumers will never get tired of observing this invention.

As far as the results are concerned, this invention not only provide the dual functions of a timing device and a liquid decorative device, but will also provide a novelty picture frame construction through its insertion channel (14) and refraction results. It demonstrates an alive dynamic scene through the float of the liquid decoration device, display its specific effects, which is therefore a real amusing and attractive product for consumers.

Thus, it is known that the major purpose of this invention is to provide a dynamic liquid decorative clock design, which affords a novel, beautiful and an alive dynamic product structure with a concise & simple construction and installation method, thereby enabling both the liquid decoration and the time clock to develop their best utilization benefits at the same time.

The secondary purpose of this invention is to utilize the clear and transparent housing and the design of magnetic induction components, so that the upper side of the housing can install a timing device, and the lower space can install a liquid decorative device. Also, the invention utilizes the oscillation of the pendulum to enable the float inside the liquid decorative device to, be affected by the magnetic induction to generate the attraction force or thrust force, and to cause unique and self-driven type of dynamic results, and effectively expand its utilization benefits and scope of application.

What is claimed is:

1. A decorative clock device comprising:

a) an external housing including an upper insertion hole and a lower internal space;

b) an electronic timing device disposed within the insertion hole and including an oscillable pendulum having a plumb provided with a first magnetic material;

c) a body of liquid contained within the internal space, a float carried by the liquid and the float being provided with a second magnetically attractive material;

d) whereby during operation of the timing device, oscillation of the pendulum causes the float to move about the liquid due to the generation of magnetic induction between the first and second materials.

2. The decorative clock device of claim 1 wherein the housing further contains a bottom provided with a pair of opposed inwardly directed U-shaped channels for receiving a picture.

3. The decorative clock device of claim 1, wherein the housing further includes a diagonal panel for refracting the contents of the picture towards a front of the housing.

4. The decorative clock device of claim 1 wherein the body of liquid includes two insoluble liquids of different specific gravities defining an interface therebetween, and the float is suspended at the interface.

5. The decorative clock device of claim 4 wherein the two liquids are further of different colors.

* * * * *